US008235219B2

(12) United States Patent
Kupper

(10) Patent No.: US 8,235,219 B2
(45) Date of Patent: Aug. 7, 2012

(54) METHOD AND DEVICE FOR SEPARATING OR CLASSIFYING MATERIAL TO BE FED

(75) Inventor: Detlev Kupper, Telgte (DE)

(73) Assignee: Polysius AG

( * ) Notice: Subject to any disclaimer, the term of this patent is extended or adjusted under 35 U.S.C. 154(b) by 206 days.

(21) Appl. No.: 12/595,763

(22) PCT Filed: Mar. 19, 2008

(86) PCT No.: PCT/EP2008/053328

§ 371 (c)(1),
(2), (4) Date: Oct. 13, 2009

(87) PCT Pub. No.: WO2008/125415

PCT Pub. Date: Oct. 23, 2008

(65) Prior Publication Data

US 2010/0116719 A1 May 13, 2010

(30) Foreign Application Priority Data

Apr. 17, 2007 (DE) ..... 10 2007 018 092

(51) Int. Cl.
*B07B 1/46* (2006.01)
*B03B 7/00* (2006.01)

(52) U.S. Cl. ..... 209/238; 209/16; 209/11

(58) Field of Classification Search ..... 209/238, 209/10, 11; 34/371, 391, 425, 499
See application file for complete search history.

(56) References Cited

U.S. PATENT DOCUMENTS

| | | | | |
|---|---|---|---|---|
| 1,647,812 | A | 11/1927 | Raun | |
| 1,899,292 | A * | 2/1933 | Rienks | 209/632 |
| 2,137,158 | A * | 11/1938 | Douglass | 432/80 |
| 2,240,718 | A * | 5/1941 | Schiffman et al. | 423/152 |
| 3,326,669 | A * | 6/1967 | Stirling | 75/750 |
| 3,432,397 | A * | 3/1969 | Berg | 201/32 |
| 3,439,652 | A | 4/1969 | Clark | |
| 3,491,492 | A * | 1/1970 | Ueltz | 51/309 |
| 3,705,620 | A * | 12/1972 | Kayatz | 165/104.18 |
| 3,802,495 | A | 4/1974 | Hordis | |
| 3,906,596 | A * | 9/1975 | Fleissner | 26/92 |
| 3,931,398 | A * | 1/1976 | Gaffar et al. | 424/244.1 |
| 3,976,423 | A * | 8/1976 | Schmidt | 432/236 |
| 4,365,953 | A * | 12/1982 | Bostelmann | 432/78 |
| 4,624,636 | A * | 11/1986 | Willis | 432/78 |
| 4,629,421 | A * | 12/1986 | Kreisberg et al. | 432/77 |
| 4,728,287 | A * | 3/1988 | Niems | 432/69 |
| 5,759,826 | A * | 6/1998 | Ahlers et al. | 435/136 |
| 5,980,291 | A * | 11/1999 | Ono | 439/247 |
| 6,450,345 | B1 * | 9/2002 | Adams et al. | 209/399 |

FOREIGN PATENT DOCUMENTS

CH 171243 A 8/1934

(Continued)

*Primary Examiner* — Stefanos Karmis
*Assistant Examiner* — Michael E Butler
(74) *Attorney, Agent, or Firm* — Gifford, Krass, Sprinkle, Anderson & Citkowski, P.C.

(57) ABSTRACT

The device according to the invention for separating or classifying material to be fed into at least two different grain fractions comprises a screen device, which is formed by rotatable elements, particularly a roller table screen, wherein at least one finer grain fraction passes between the rotatable elements and means are provided for cooling the rotatable elements.

10 Claims, 9 Drawing Sheets

FOREIGN PATENT DOCUMENTS

Figure 1:
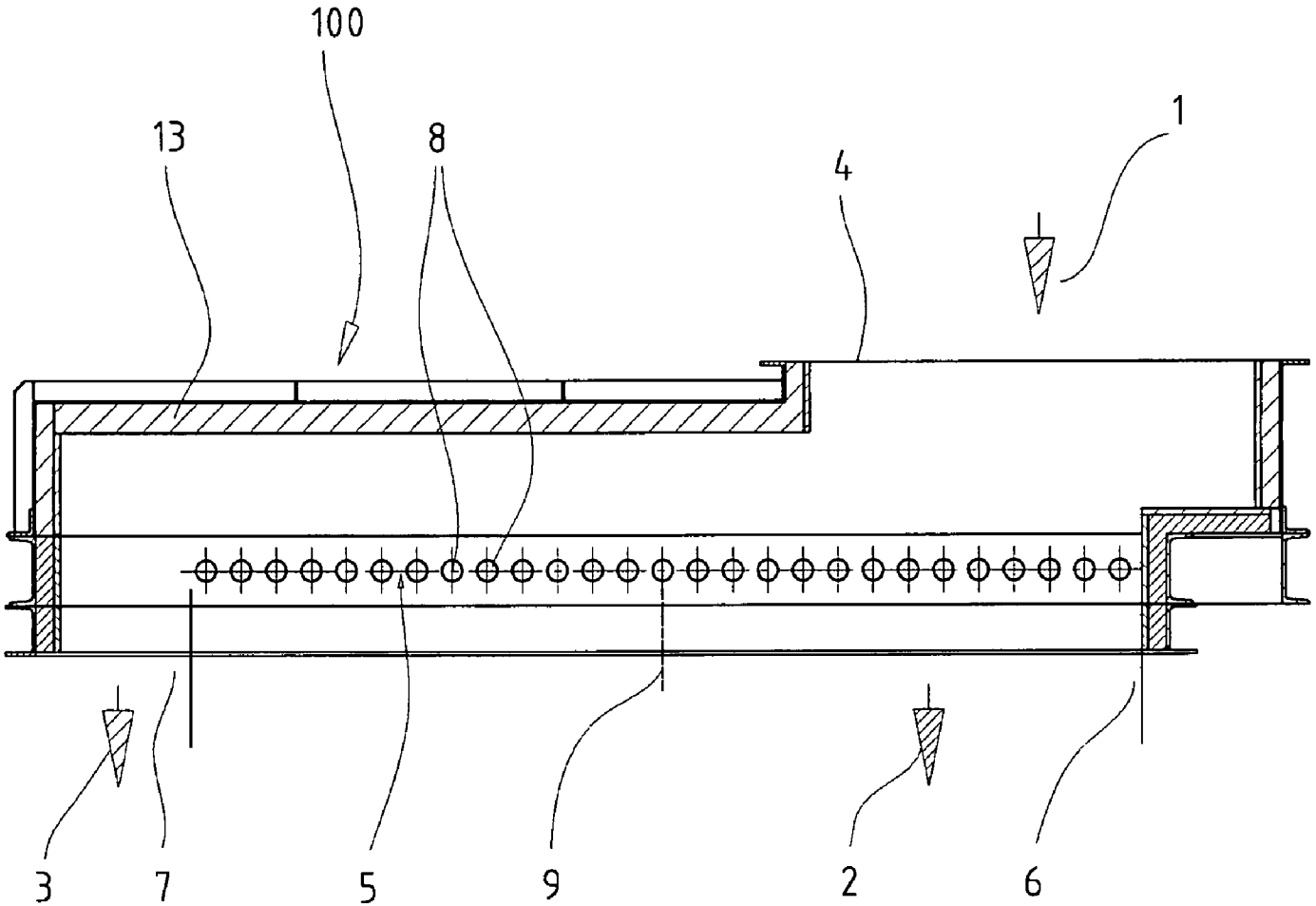

| | | | |
|---|---|---|---|
| DE | 518605 | C | 2/1931 |
| DE | 729397 | C | 12/1942 |
| DE | 1111571 | B | 7/1961 |
| DE | 1124892 | B | 3/1962 |
| GB | 916544 | A | 1/1963 |
| WO | WO-01/09548 | A1 | 2/2001 |

* cited by examiner

METHOD AND DEVICE FOR SEPARATING OR CLASSIFYING MATERIAL TO BE FED

The invention relates to a method and a device for separating or classifying feedstock into at least two different grain fractions, with a screen device which is formed by rotatable elements, especially a roller table screen, at least one finer grain fraction falling through between the rotatable elements.

In the field of the heat treatment of raw materials, especially in the pre-heating or calcination of raw materials of the cement or lime industry, a separation or classification of the material is often necessary between two heat treatment steps. For that purpose, for example, classifying screens and fluidised bed devices are used. Owing to the hot material, which may have temperatures of more than 750° C., blockages and restrictions in the operation of the screen device occur constantly.

DE-AS-1 124 892 discloses a rotary bar screen system or sieve bottom system which can be cooled or heated by means of electrical energy, liquids or gases. A cooled classifying screen has, however, not been used hitherto in the heat treatment of raw materials, especially during the pre-heating or calcination of raw materials of the cement or lime industry.

The object of the invention is to improve the method and the device for separating or classifying feedstock in the field of the heat treatment of raw materials, especially during the pre-heating or calcination of raw materials of the cement or lime industry.

According to the invention, that object is achieved by the features of claims 1, 11 and 15.

The device according to the invention for separating or classifying feedstock into at least two different grain fractions has a screen device which is formed by rotatable elements, especially a roller table screen, at least one finer grain fraction falling through between the rotatable elements and means being provided for supplying a cooling medium to the rotatable elements. The rotatable elements have a basic body and an outer casing, the basic body providing a duct which extends in the direction of its axis of rotation and which can be acted upon by the cooling medium and which is connected to the means for supplying the cooling medium.

Although roller table screens are known in other fields, especially in coaling plants, those roller table screens are used only at ambient temperatures. Use under extreme conditions, such as prevail, for example, during the pre-heating or calcination of raw materials of the cement or lime industry, has hitherto still not been proposed.

The outer casing has, in particular, a wear-protection and/or temperature-protection function, whilst the basic body is used as a carrying body, the carrying capacity thereof being markedly increased by the cooling operation.

In the method according to the invention, the feedstock has a temperature of at least 250° C., especially of at least 750° C. Owing to the provision of the means for cooling the rotatable elements, the roller table screen can be used under those extreme conditions.

Further configurations of the invention are the subject-matter of the subordinate claims.

The screen device is preferably in the form of a roller table screen and the rotatable elements are in the form of rollers or cylinders. The rotatable elements are used as conveying elements for a larger grain fraction and at least some of them are driveable for that purpose.

According to a preferred embodiment, insulation can be provided between the outer casing and the basic body, so that inexpensive cooling of the basic body by means of air may be considered.

The rotatable elements are advantageously supported outside the housing, it being additionally possible to provide for the bearings to be cooled.

The device for separating or classifying feedstock is preferably used in a plant for the heat treatment of feedstock, especially raw material, having a pre-heater for pre-heating the feedstock, and a rotary tubular kiln for burning the feedstock. The device for separating and classifying is arranged between the pre-heater and the rotary tubular kiln.

Further advantages and configurations of the invention will be explained in more detail hereinafter by means of the description and the drawings.

Figure 2:
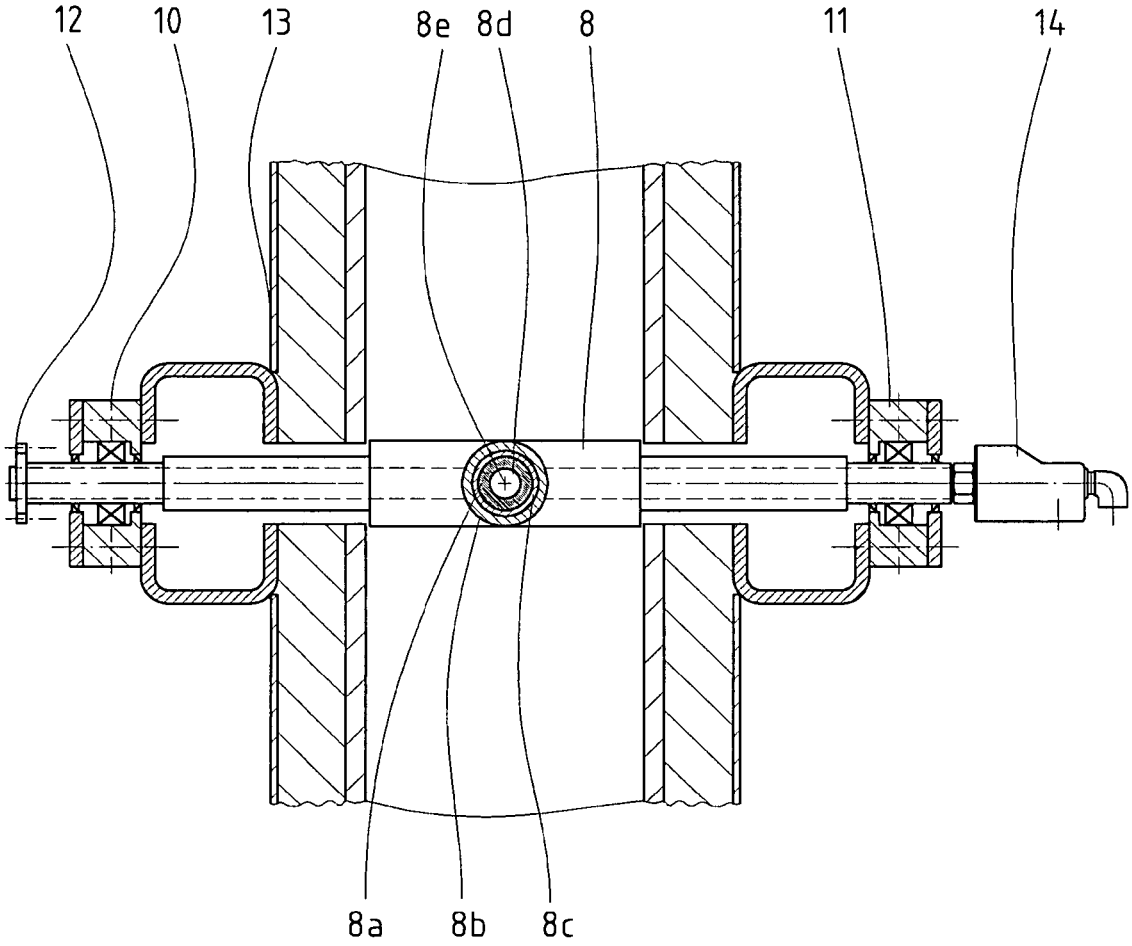
Figure 3:
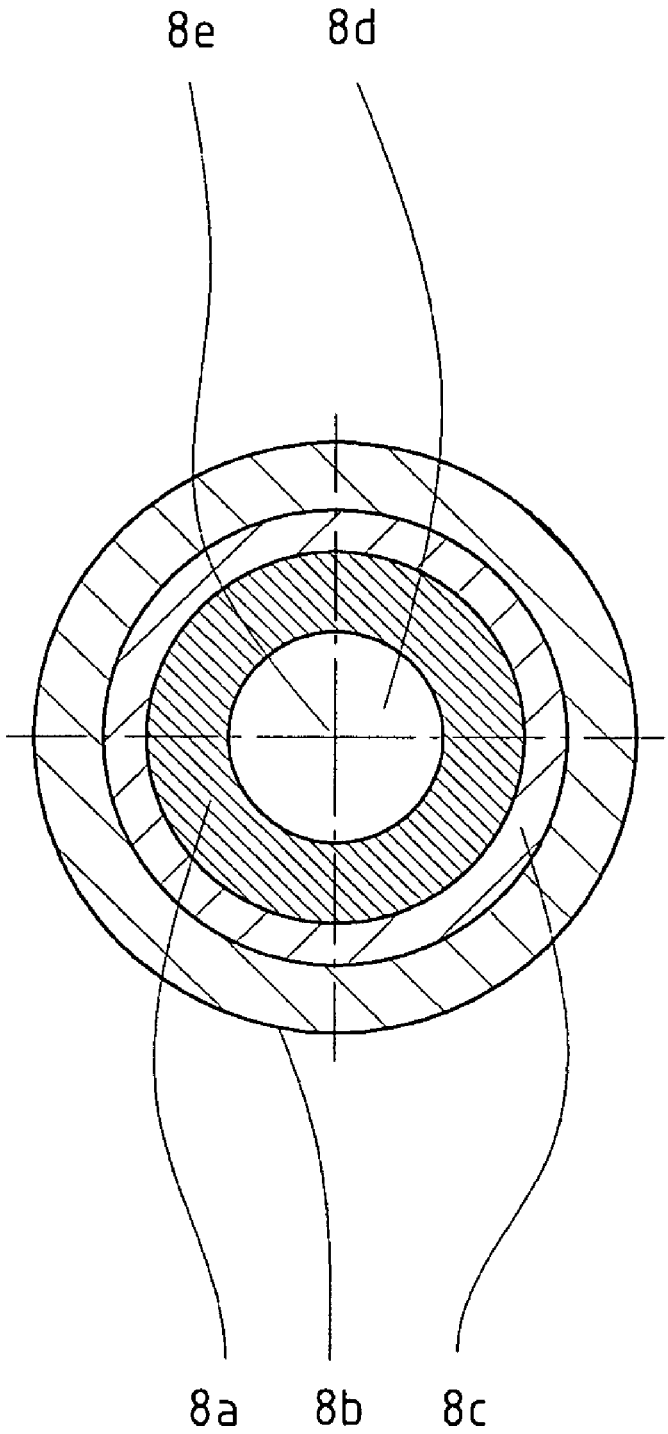
Figure 4:
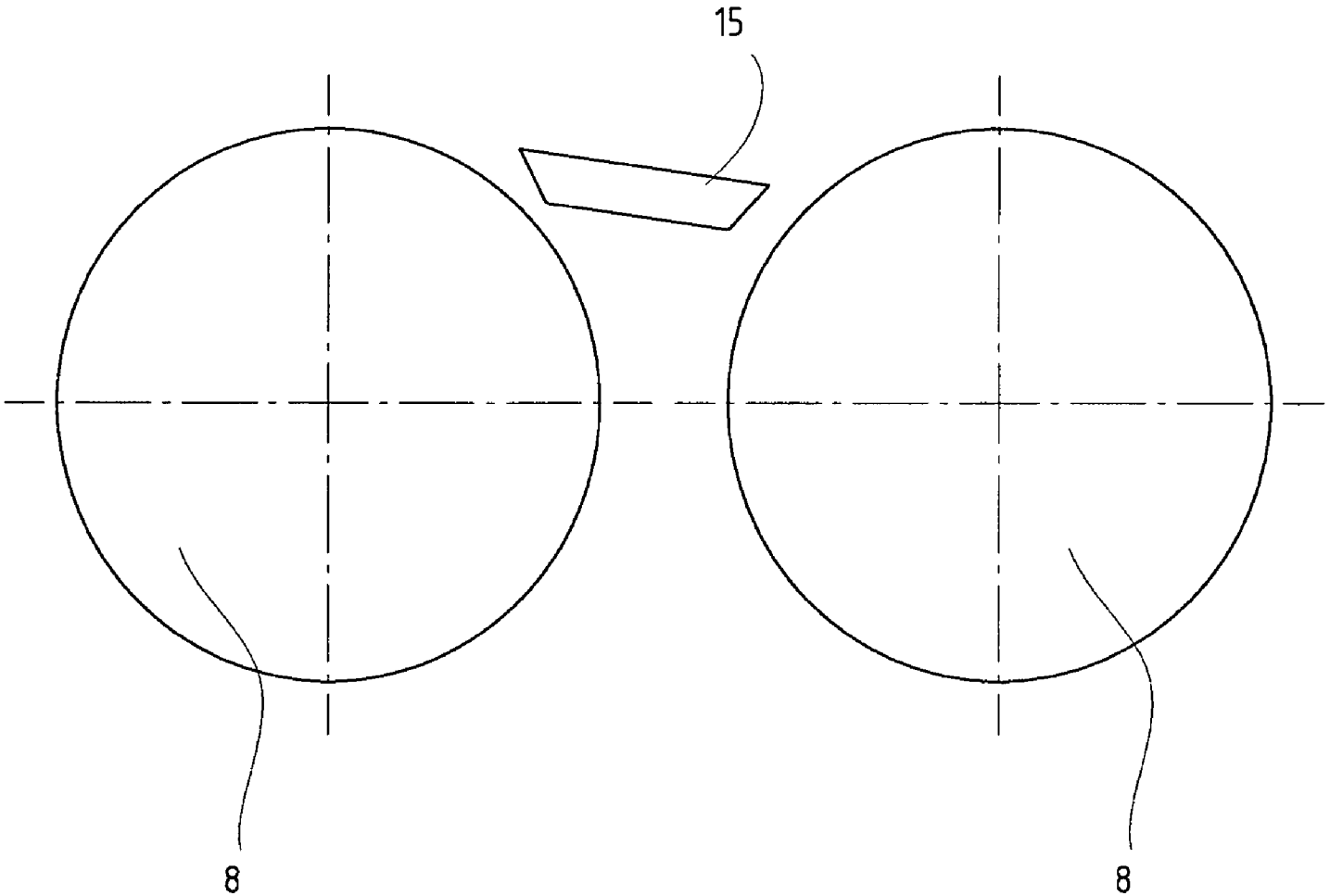
Figure 5:
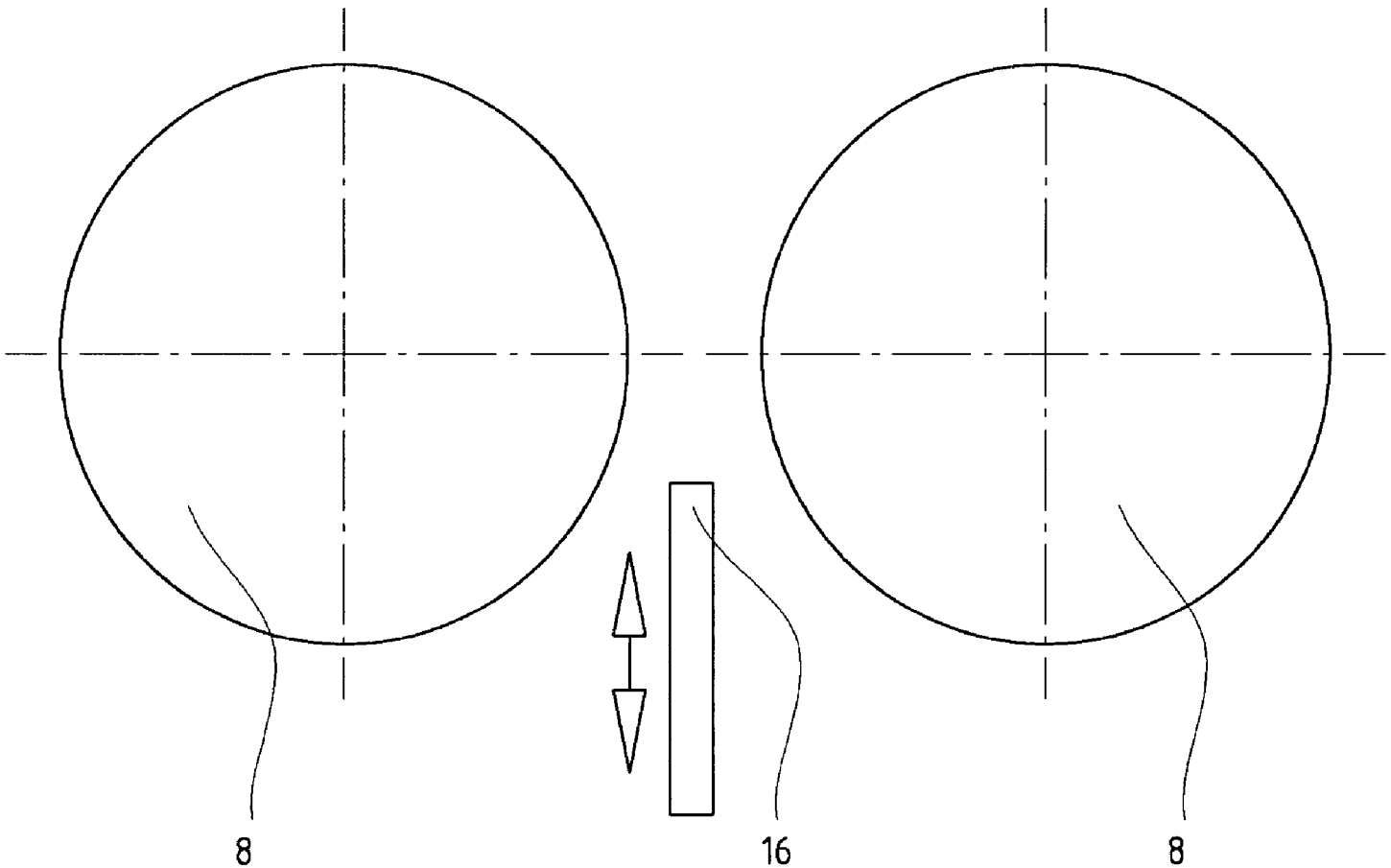
Figure 6:
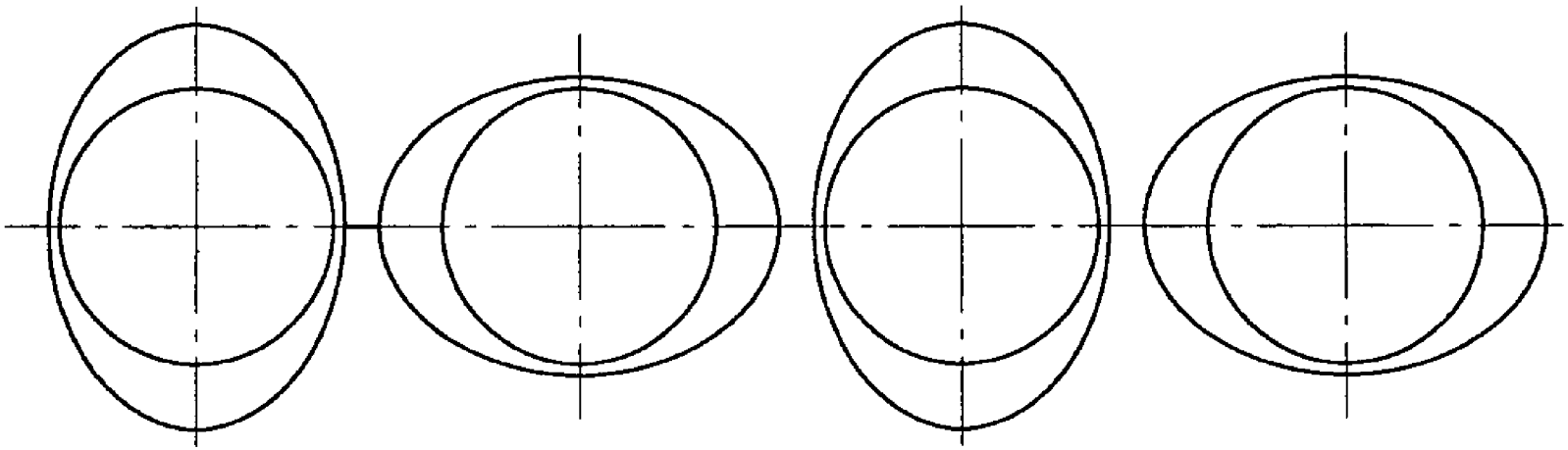
Figure 7:
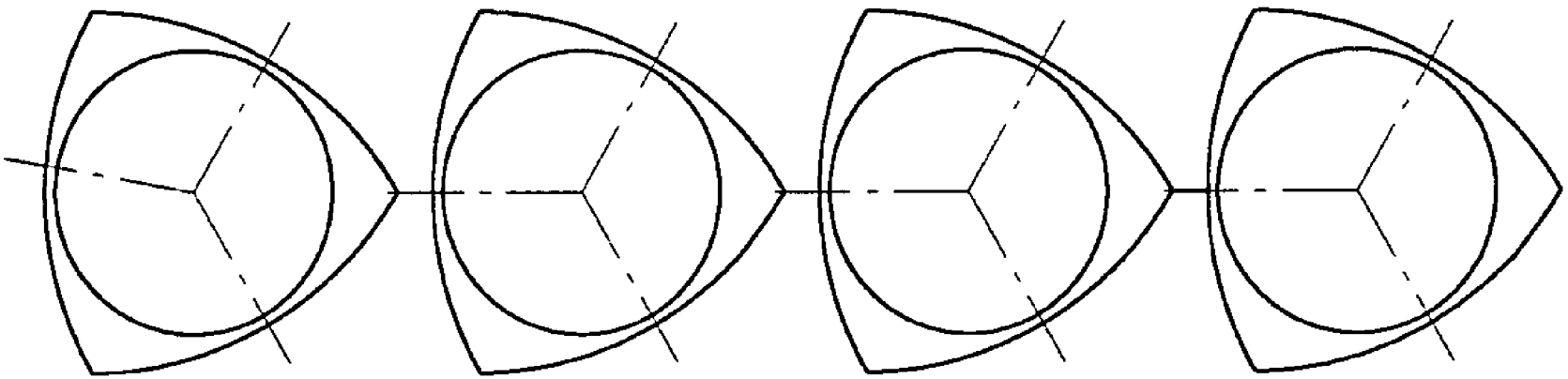
Figure 8:
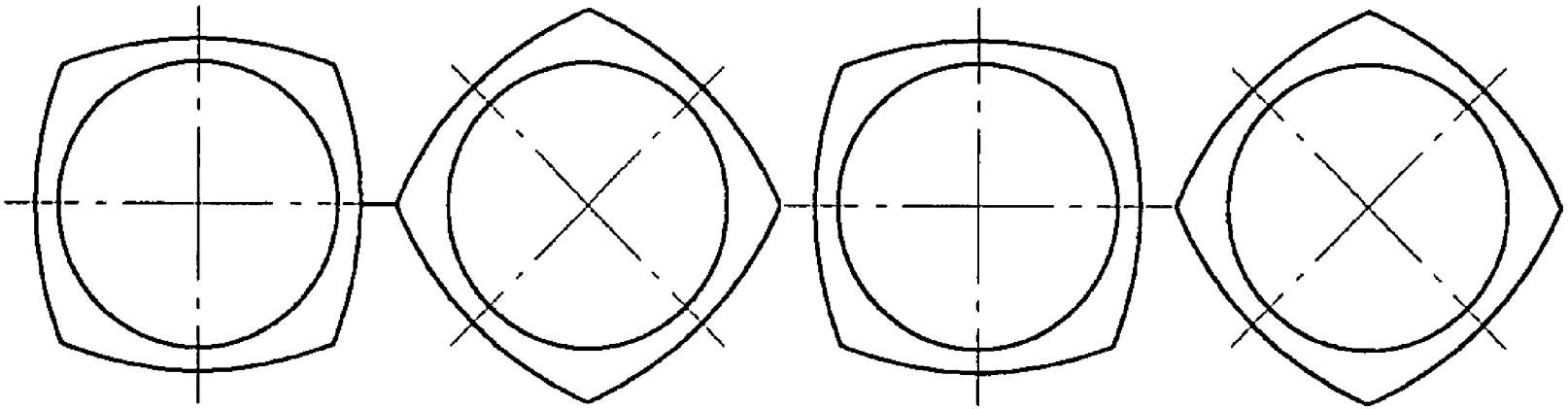
Figure 9:
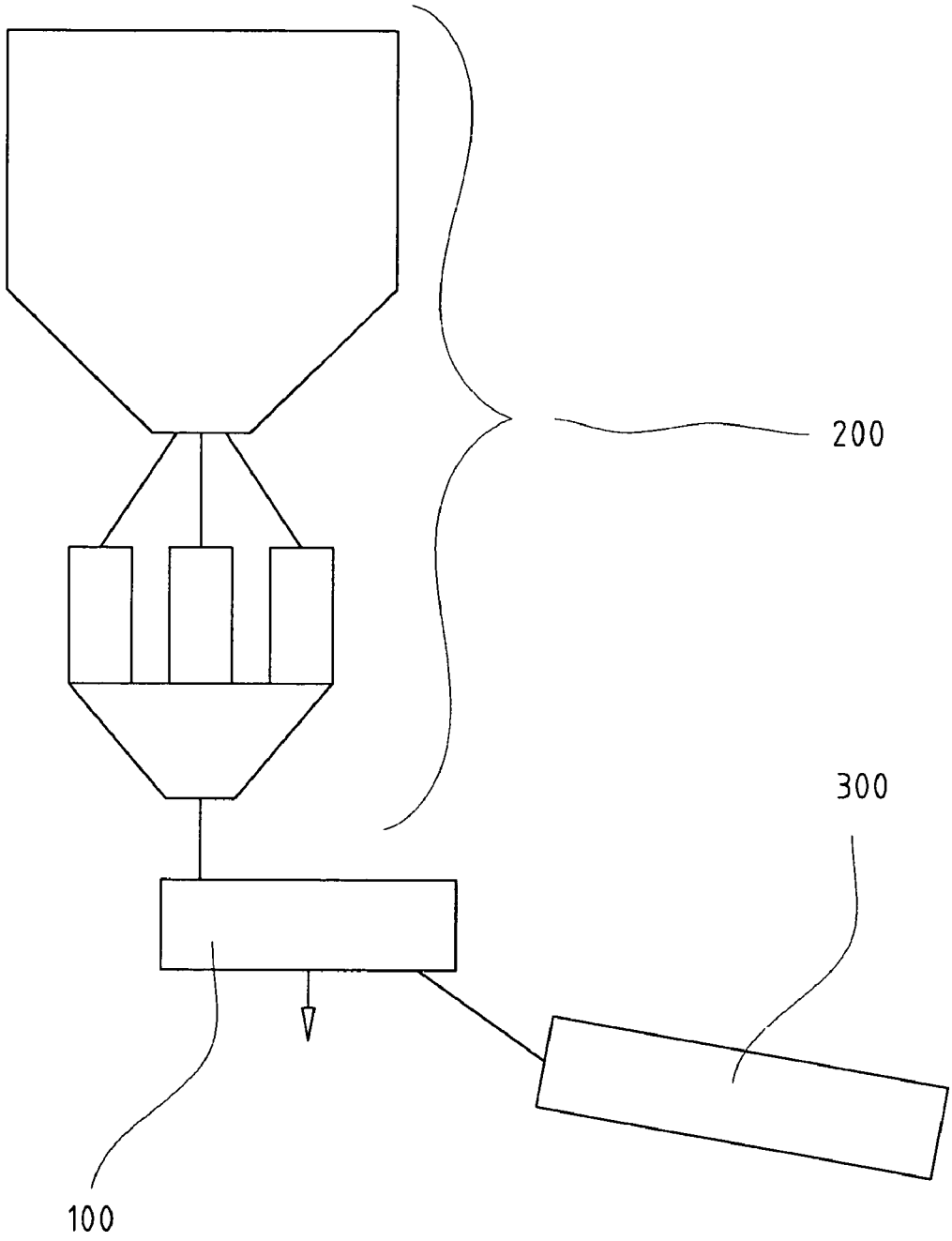

FIG. 1 is a diagrammatic view in longitudinal section of the device according to the invention for separating or classifying feedstock, FIG. 2 is a diagrammatic side view in the region of a rotatable element, FIG. 3 is a sectional view of a rotatable element, FIG. 4 is a sectional view in the region of adjacent rotatable elements with a material guide element, FIG. 5 is a sectional view in the region of adjacent rotatable elements with means for cleaning the nip between the two rotatable elements, FIG. 6 to FIG. 8 are various cross-sectional views of the rotatable elements and FIG. 9 is a diagrammatic view of a plant for the heat treatment of feedstock.

The device 100 shown in FIG. 1 and FIG. 2 for separating or classifying feedstock 1 into at least two different grain fractions 2, 3 has a feed opening 4, a screen device 5 in the form of a roller table screen and at least one outlet opening 6 for a finer grain fraction 2 and an outlet opening 7 for a coarser grain fraction 3.

The screen device 5 provides a large number of rotatable elements 8 in the form of rollers or cylinders, at least some of which are driveable. The finer grain fraction 2 falls through between the rotatable elements 8, so that the distance between two adjacent rotatable elements determines the size of the finer grain fraction 2. The distance may be the same or different over the length of the screen. Preferably, the distance between adjacent rotatable elements 8 is adjustable.

In FIG. 1, it is indicated by means of the wall 9 drawn with a broken line that different grain fractions could be drawn off as screened matter over the length of the screen device 5. For that purpose, the distance between the rotatable elements 8 in the first portion of the screen device 5 would be made narrower than in the second section. The coarser grain fraction 3, which does not fall downwards between the rotatable elements 8, is conveyed by the rotatable elements to the outlet opening 7. The rotatable elements therefore also have a conveying function in addition to the separating or classifying function.

The rotatable elements 8 are supported in bearings 10, 11 and can be driven by means of suitable drive means 12 (shown only schematically in the drawing). The bearings 10, 11 are advantageously arranged outside a housing 13 of the device 100 in order to protect them from the effects of dust and temperature.

As can be seen from FIGS. 2 and 3, the rotatable element 8 comprises a basic body 8*a* and a suitably wear-resistant and/or temperature-resistant casing 8*b* in order to ensure a sufficient service life in the processing of the feedstock. Suitable insulation 8*c* can optionally also be provided between the basic body 8*a* and the casing 8*b*.

The basic body 8*a* has a duct 8*d* which extends in the direction of its axis of rotation 8*e* and which can be acted upon by a cooling medium and which is connected to means 14 for supplying a cooling medium. Liquid and/or gaseous coolant media, such as water or air, may be considered. Means for cooling, which are not shown in detail, can also be provided for the bearings 10, 11.

The screen device 5 can be arranged to be both horizontal and inclined. In both cases, it may be advantageous if a material guide element 15 is provided between two adjacent rotatable elements 8 in order to prevent an undesirable filling of the space between the two cylinders and thereby to improve the conveying action (FIG. 4).

Nevertheless, larger particles will continue to become stuck in the region of the nip and thereby impair the separating or classifying action. The rotatable elements 8 could therefore be constructed and supported in such a manner that a comminution of such material takes place in the nip between two adjacent rotatable elements 8.

A further possibility for removing any blockages in the nip between two rotatable elements 8 is shown in FIG. 5. What is involved here is means or an element 16 for cleaning the nip as a result of the fact that this element is arranged beneath the nip and can be inserted upwards into the nip.

The cross-sectional shape of the rotatable elements 8 is in no way limited to a circular shape. FIGS. 6 to 8 show various cross-sectional shapes of the rotatable elements 8. The characteristic feature of those elements resides in the fact that, when they are rotated synchronously, a substantially constant nip remains. The advantage of an elliptical element (FIG. 6), a cross-sectionally triangular (FIG. 7) or rectangular element (FIG. 8) having rounded side faces consists above all in the improved conveying action.

In the context of the invention, however, it is of course also possible to use identical or differently shaped rotatable elements 8 over the length of the screen device.

Different sizes of a specific shape can also be provided for.

Generally, all of the rotatable elements 8 are driven in the same direction of rotation, it being possible to provide for regulation of the speed of all or some of the rotatable elements.

In order to clear any blockages in the region of the nips, it may also be advantageous to drive the rotatable elements 8 for a short period counter to the normal direction of rotation.

FIG. 9 shows very schematically a plant for the heat treatment of feedstock. The plant has, in particular, a pre-heater for pre-heating the feedstock, especially raw material, a device 100 for separating or classifying feedstock, and a rotary tubular kiln for burning the pre-heated feedstock. The device 100 for separating or classifying feedstock is arranged between the pre-heater 200 and the rotary tubular kiln 300 in order to separate out a grain fraction which is undesirably fine for the rotary tubular kiln.

The invention claimed is:

1. A plant for the heat treatment of feedstock having a pre-heater (200) for pre-heating the feedstock and a rotary tubular kiln (300) for burning the pre-heated feedstock, characterized in that a device (100) for separating or classifying feedstock (1) into at least two different grain fractions (2, 3) is arranged between the pre-heater (200) and the rotary tubular kiln (300), the device having a screen device (5) which is formed by rotatable elements (8), at least one finer grain fraction (2) falling through between the rotatable elements and means (14) being provided for supplying a cooling medium to the rotatable elements (8), and wherein the rotatable elements (8) have a basic body (8*a*) and an outer casing (8*b*), the basic body (8*a*) having a duct (8*d*) which extends in the direction of its axis of rotation (8*e*) and which can be acted upon by a cooling medium and which is connected to the means (14) for supplying the cooling medium.

2. The plant according to claim 1, wherein the screen device is in the form of a roller table screen and the rotatable elements (8) are in the form of rollers or cylinders.

3. The plant according to claim 1, wherein at least some of the rotatable elements (8) are connected to a drive.

4. The plant according to claim 1, wherein the distance between at least some of the rotatable elements (8) is adjustable.

5. The plant according to claim 1, wherein the rotatable elements (8) are provided inside a housing (13) and the rotatable elements (8) are supported in bearings (10, 11) which are arranged outside the housing.

6. The plant according to claim 5, wherein the bearings (10, 11) have means for cooling.

7. The plant according to claim 1, wherein the outer casing (8*b*) of the rotatable elements (8) is wear-resistant and/or temperature-resistant.

8. The plant according to claim 1, wherein material guide elements (15) are provided between two adjacent rotatable elements (8).

9. The plant according to claim 1, wherein there are provided between two adjacent rotatable elements (8), means (16) for cleaning the nip between the two rotatable elements.

10. The plant according to claim 1, wherein the rotatable elements (8) have a non-circular shape but a substantially constant nip remains between two adjacent rotatable elements during the rotational movement.

* * * * *

UNITED STATES PATENT AND TRADEMARK OFFICE

CERTIFICATE OF CORRECTION

PATENT NO. : 8,235,219 B2
APPLICATION NO. : 12/595763
DATED : August 7, 2012
INVENTOR(S) : Detlev Kupper It is certified that error appears in the above-identified patent and that said Letters Patent is hereby corrected as shown below:

In the Title Page:

(30) Foreign Application Priority Data

Delete "10 2007 018 092" Insert -- 10 2007 018 092.8 --

Signed and Sealed this
Nineteenth Day of February, 2013

Teresa Stanek Rea
*Acting Director of the United States Patent and Trademark Office*